343-756 SR
7/22/80 OR 4,214,248

United States Patent [19]
Cronson et al.
[11] 4,214,248
[45] Jul. 22, 1980

[54] TRANSREFLECTOR SCANNING ANTENNA

[75] Inventors: Harry M. Cronson, Lexington; David Lamensdorf, Arlington; Gerald F. Ross, Lexington, all of Mass.

[73] Assignee: Sperry Corporation, New York, N.Y.

[21] Appl. No.: 918,182

[22] Filed: Jun. 22, 1978

[51] Int. Cl.[2] ..... H01Q 3/18; H01Q 15/24
[52] U.S. Cl. ..... 343/756; 343/761; 343/786
[58] Field of Search ..... 343/756, 761, 854, 786, 343/909

[56] References Cited

U.S. PATENT DOCUMENTS

| | | | |
|---|---|---|---|
| 2,820,965 | 1/1958 | Sichak | 343/756 |
| 2,871,477 | 1/1959 | Hatkin | 343/756 |
| 3,234,559 | 2/1966 | Bartholomäo et al. | 343/779 |
| 3,916,416 | 10/1975 | Lewis | 343/756 |
| 3,938,159 | 2/1976 | Ajioka et al. | 343/756 |
| 4,144,535 | 3/1979 | Dragone | 343/756 |

FOREIGN PATENT DOCUMENTS

| | | | |
|---|---|---|---|
| 1913610 | 10/1969 | Fed. Rep. of Germany | 343/756 |
| 776258 | 6/1957 | United Kingdom | 343/761 |

*Primary Examiner*—Eli Lieberman
*Attorney, Agent, or Firm*—Howard P. Terry; Seymour Levine

[57] ABSTRACT

A 360 degree fan beam scanning antenna which includes a transreflector created by a plurality of reflecting elements arranged on a surface of revolution formed about a generating axis and a feed antenna rotatable about the internal focal circle of the transreflector that provides an illumination beam for the transreflector which minimizes spillover and antenna pattern skewing.

6 Claims, 5 Drawing Figures

TRANSREFLECTOR SCANNING ANTENNA

BACKGROUND OF THE INVENTION

1. Field of the Invention

The present invention relates to scanning antennas and more particularly to antennas capable of providing relatively high directivity with 360° antenna coverage.

2. Description of the Prior Art

Many radar systems require narrow beam antennas with 360° azimuthal scanning capabilities. This has been achieved with various methods one of which is the mechanical rotation of an entire antenna assembly comprising a large reflector and a feed system therefor. Due to the large inertia of these systems considerable driving power is required and the rapidity with which scanning may be accomplished is severely limited.

Mechanically scanned antennas have been developed which provide 360° azimuth scan with a significantly reduced inertia than the fixed feed reflector system. In these systems the reflecting structure is a spherical or parabolic torus reflector which is stationary and the feed system is caused to rotate about the internal focal circle of the reflector. The reflecting surface comprises appropriately spaced reflecting rods which make an angle of 45° with all the vertical meridians, each rod giving the effect of a barber pole stripe. By virtue of this effect a perpendicular relationship exists between rods diametrically positioned, the entire surface forming a transreflector. Thus a feed antenna positioned at the focal circle of the transreflector, radiating with a polarization vector that is parallel to reflecting rods on the inner surface of the torus which are thereby illuminated, will have a signal transmitted therefrom focussed by the illuminated area of the reflecting surface, the reflected signal appearing at the opposite surface with a polarization that is normal to the reflecting rods thereat and thereby propagate through the surface. Since the reflecting surface is circularly symmetric, the focussing of the beam is independent of the angular position of the feed antenna on the focal circle. Thus, a focussed scanned beam may be obtained by rotating the feed about the focal circle. Scanning antennas utilizing the transreflector principle are described in U.S. Pat. No. 2,835,890, issued to B. J. Bittner in May 1958 and in U.S. Pat. No. 2,989,746, issued to J. F. Ramsey in June 1961. These antennas are designed to provide beam shapes which exhibit pencil beam characteristics and though they can provide relatively rapid scanning, are limited with respect to the scan rate achievable. The present invention is directed to transreflector antennas that provide shaped beam characteristics and increased scan rates over that previously achievable.

SUMMARY OF THE INVENTION

An antenna capable of scanning a fan shaped beam through 360° includes a stationary transreflector, which may be an annulus of a spherical or parabolic torus, the surface of which is comprised of reflecting rods that are oriented at 45° with respect to the meridians of the torus, and a feed system that illuminates successive sections of the annulus as it rotates about the focal circle of the torus. The rotating feed system produces an illumination pattern that is shaped to minimize spillover and radiates with a polarization vector which is parallel to the reflecting rods to maximize reflections therefrom. This polarization and illumination pattern is obtained, in one embodiment of the invention, with a plurality of horns, arrayed in a unique manner and in another embodiment with a flared horn having appropriately slanted grids positioned across its open ends.

The feed system may provide a plurality of illuminating beams, each of which produces a scanned fan shape beam in space. This plurality of illuminating beams may be utilized to increase the 360° scan rate for a given feed system rotation rate or to reduce the feed system rotation rate for a given scan rate.

DESCRIPTION OF THE PREFERRED EMBODIMENTS

Relatively rapid scan over wide angular sectors including 360° may be accomplished with antennas comprising spherical or torus shaped transreflectors with a feed antenna transversing the focal circle therewithin. These systems provide pencil beam radiation patterns which traverse the desired angular sectors. Applications exist, however, wherein pencil shaped radiation patterns are not as desirable as fan shaped radiation patterns; that is, a radiation pattern with a narrow beam width in one plane and a broad beam width in the other. This fan shaped beam may be realized with the utilization of an annulus of appropriate dimensions cut from a spherical or torus transreflector, which may be offset from the focal plane of the transreflector in which the feed horn is located, to provide an antenna capable of scanning over large angular sectors with a minimum of aperture blockage.

Figure 1:
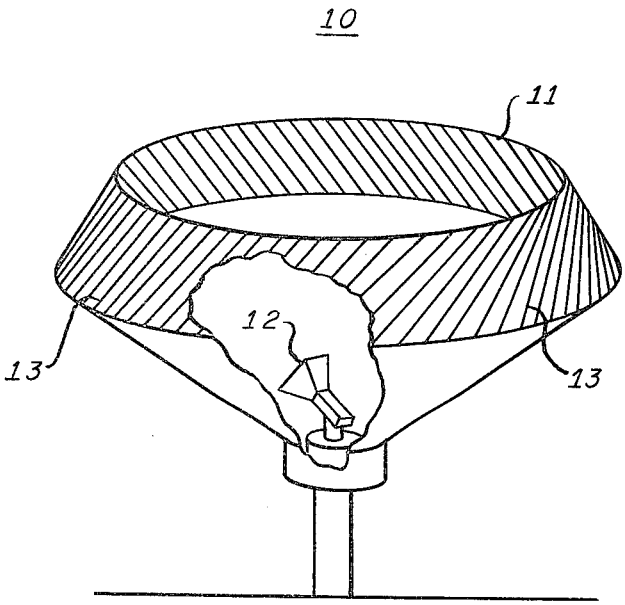
FIG. 1 is a schematic representation of a transreflector antenna system for providing a fan shaped beam.

In FIG. 1, an antenna 10 capable of scanning a fan beam through 360° is shown which comprises an annulus transreflector 11 and a 360° rotatable feed antenna 12. The transreflector 11 may be an annulus cut from a spherical reflector such as that described in U.S. Pat. No. 2,835,890 and by Flaherty et al in the 1958 IRE National Convention Record at page 158 or from a parabolic torus such as that described by J. D. Burab et al in the 1958 IRE Wescon Convention Record at page 272. Transreflector 11 comprises metallic rods 13 each of which may have a diameter of approximately 0.01 wavelengths ($\lambda$) with spacings therebetween which may be in the order of $0.1\lambda$ and which form angles of substantially 45° with the vertical meridians within the annulus sector at the crossing points thereof. The antenna feed 12 should provide a narrow radiation pattern in the vertical plane to minimize radiation spillover at the annulus 11 and a broad radiation pattern in the horizontal plane to establish a narrow radiation pattern in that plane for the antenna 10. In addition to the fan beam radiation pattern just described, the feed antenna 12 should provide a polarization vector at an angle of substantially 45°. Fan beam patterns with 45° polarization may be realized from a flared horn which is rotated such that the projection of each side of the horn on the surface of the annulus forms an angle of substantially 45° with the local meridians of the annulus. This configuration, however, would create a phase center locus at an angle of 45° to the meridians and would establish a skewed illumination pattern in the reflecting angular sector, thereby increasing the spillover radiation and causing a similarly skewed radiation pattern from antenna 10.

Figure 2:
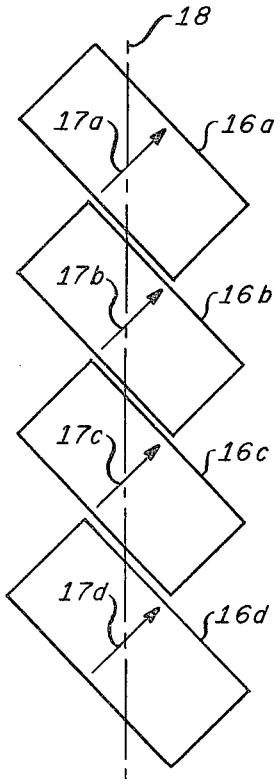
FIG. 2 is a representation of an antenna aperture configuration suitable for the feed antenna of FIG. 1.
Figure 3:
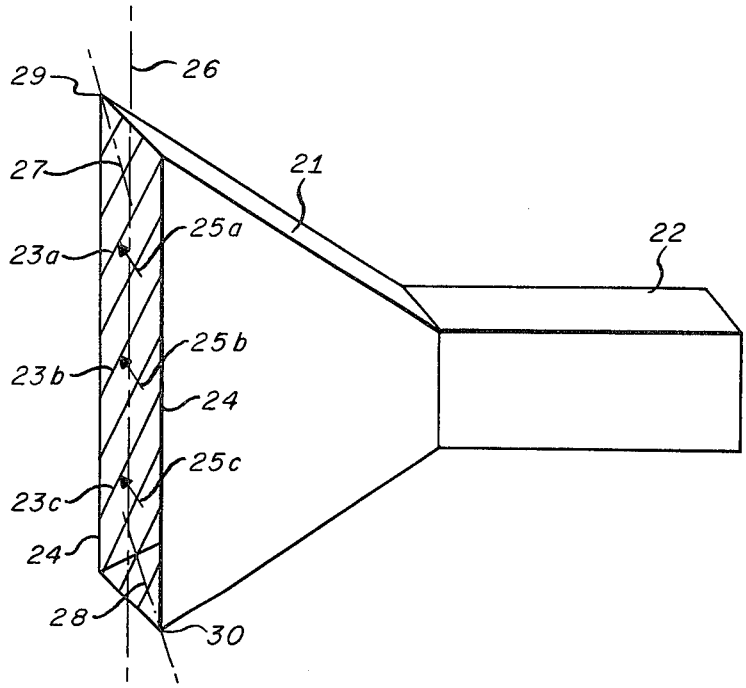
FIG. 3 is an illustration of a modified H-plane horn suitable for use as the feed antenna of FIG. 1.

An aperture configuration which provides a narrow beam vertical pattern, a broad beam horizontal pattern, and 45° polarization while maintaining a phase center locus which is substantially parallel to the meridians of the annulus is shown in FIG. 2. This configuration may be obtained by rotating a multiplicity of waveguides through an angle of 45° with respect to the meridians of the annulus and positioning the open ends as for example 16*a*, 16*b*, 16*c*, and 16*d*, in the focal region of the annulus 10 such that the central polarization vectors of each open ended waveguide 17*a* through *d* are aligned with their centers along a line 18 which is parallel to the central meridian in the illuminated region. This configuration provides the illumination pattern and the polarization desired in the illuminated region of the annulus 11. To obtain the aperture configuration shown in FIG. 2, a corporate feed is required which provides the proper amplitude and phase distribution at each open end 16*a* through 16*d* of the waveguides. A simpler feed antenna aperture configuration that is substantially equivalent to that of the aperture of the configuration of FIG. 2 is shown in FIG. 3. Referring to FIG. 3, a horn 21, flared in the H plane of a waveguide 22, has grids positioned across the mouth thereof such as the grids 23*a*, 23*b* and 23*c*, all of which form an angle of 45° with the vertical edges 24 of the horn 21. The horn 21 is positioned in the focal plane of the annulus 11 such that the grids are all substantially perpendicular to the illuminated reflecting rods 13. The radiation polarization vectors from this horn are perpendicular to each grid and thus are substantially parallel to the illuminated reflecting rods 13. Central polarization vectors between adjacent grids, as for example, vectors 25*a*, 25*b* and 25*c* which lie between the grids 23*a* and 23*c*, all have their centers along the center line 26 of the mouth of the horn 21. Central vectors in the corners of the horn, however, have centers which lie along the lines 27 and 28, line 27 being determined by the center of the grid 23*a* and the corner 29 of the mouth of the horn 21 while the line 28 is determined by the center of the grid 23*c* and the corner 30 of the mouth of the horn 21. Grids 23*a* and 23*c* being the last grids at either end of the horn mouth which extend from side wall to side wall. Since the maximum radiation from the horn is in the central region thereof, relatively little energy exists in the corners. Thus, the skewing component occasioned by the offset of the phase centers in the corner region have little effect on the over-all radiation pattern from the mouth of the horn 21. Though the gridded mouth horn is shown as an H-plane horn in FIG. 3, it should be apparent to those skilled in the art that a similar result may be obtained with an E-plane horn.

Figure 4:
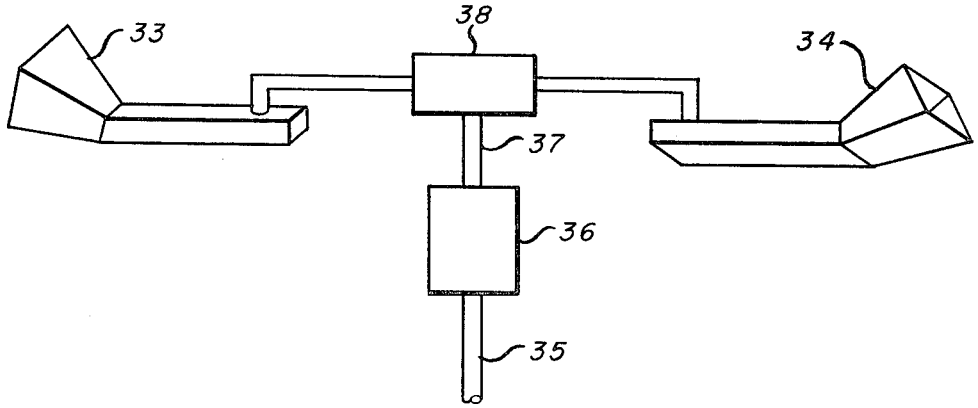
FIG. 4 is an illustration of a feed antenna assembly useful for increasing the scan rate of the antenna of FIG. 1.

A dual beam system may be realized with a transreflector by providing a feed system therefor containing two or more radiating devices rotating about the focal circle. FIG. 4 is an illustration of a two-horn feed system though the radiating devices are shown as horns in FIG. 4, it will be apparent to those skilled in the art that other radiating configurations may be employed, including the array shown in FIG. 2. Feed horns 33 and 34 are diametrically mounted in a counter-balanced relationship about a rotating waveguide 37 and are fed through a transmission line 35, a rotary joint 36, the rotating waveguide 37, and a feed distribution 38. The system may operate at a single frequency wherefore the feed distribution may be an electronic switch of the ferrite or diode type which may alternately couple one or more pulses to the feed horns 33 and 34. Since the feed horns 33 and 34 are diametrically positioned each revolution of the feed system provides a 360° scan, i.e., the antenna system's scanning rate is twice the feed horn system's rotation rate.

Figure 5:
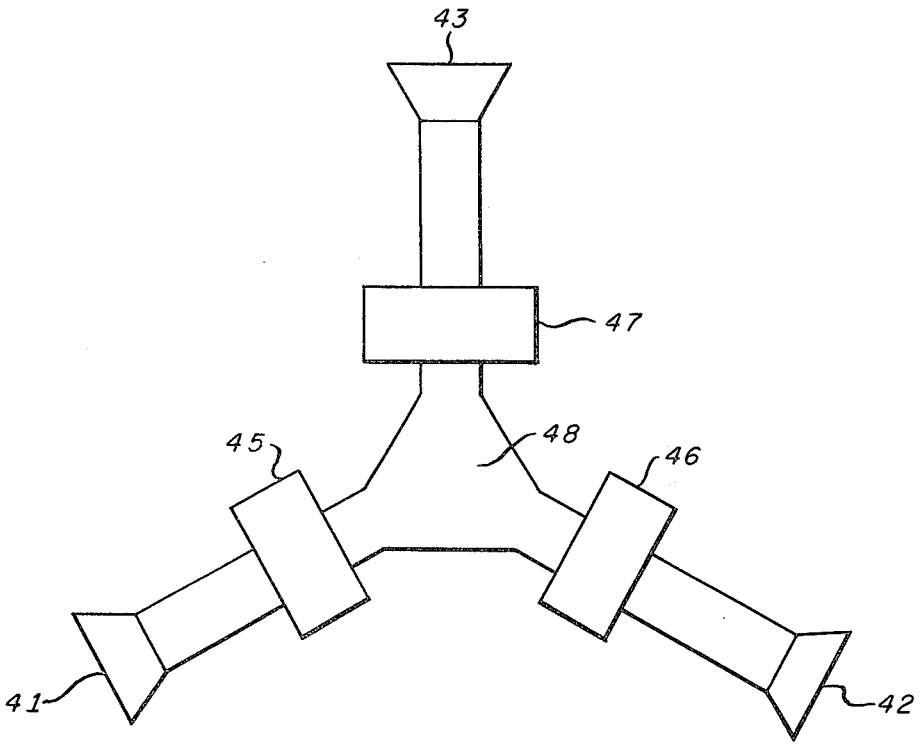
FIG. 5 is another illustration of a feed antenna assembly useful for increasing the scan rate of the antenna of FIG. 1.

Multiple frequency operation, wherein each beam is radiated at a different frequency may utilize a feed system such as the three-horn feed system illustrated in FIG. 5. Referring to FIG. 5, three feed horns 41, 42 and 43 are respectively fed through bandpass filters 45, 46 and 47 which coupled to a filter distribution center 48. Electromagnetic signals coupled to the distribution center 48 are distributed to the three output ports thereof. Signals within, for example, the bandpass of filter 47 are reflected from filters 45 and 46 such that substantially all electromagnetic energy contained within this band are coupled through filter 47 to antenna 43. The operation of the feed system is similar for electromagnetic signals within the bandpasses of filters 41 and 45.

While the invention has been described in its preferred embodiments, it is to be understood that the words which have been used are words of description rather than limitation and that changes may be made within the purview of the appended claims without departing from the true scope and spirit of the invention in its broader aspects.

We claim:

1. An antenna of the type that includes a transreflector and a feed antenna therefor, said transreflector having an internal focal circle and created by a plurality of reflecting elements arranged on a surface of revolution formed about a generating axis whereon each of said reflecting elements is in an angular relationship of substantially 45° with each crossed meridian of said surface of revolution, wherein said feed antenna comprises an array of simultaneously operable radiation devices each oriented to provide a radiation polarization vector when radiating that is substantially parallel to directly illuminated reflecting elements and positioned with respect to one another such that the locus of their radiation phase centers is a line which forms an angle of substantially 45° with said radiation polarization vector.

2. An antenna of the type that includes a transreflector and a feed antenna therefor, said transreflector having an internal focal circle and a plurality of reflecting elements arranged on a surface of revolution formed about a generating axis, whereon each of said reflecting elements is in an angular relationship of substantially 45° with each crossed meridian of said surface of revolution, wherein said feed antenna comprises:

a flared horn having first and second side walls and a substantially rectangular planar open end with long and short axes, said first and second side walls being substantially parallel to said long axis;

a plurality of reflecting grids positioned in said open end, each forming an angle of substantially 45° with at least one of said first and second side walls, whereby, when said flared horn is radiating, polarization vectors are established between adjacent reflecting grids which are substantially perpendicular to said grids and form angles of substantially 45° with said long axis, said polarization vectors being substantially parallel to directly illuminated reflecting elements of said transreflector and constructed such that the central polarization vector of the polarization vectors between adjacent grids that extend from said first side wall to said second side wall have their centers along a line parallel to and substantially centered between said first and second side walls.

3. An antenna in accordance with claim 1 wherein said transreflector is an annulus of said surface of revolution, said annulus being located above the plane of said internal focal circle.

4. An antenna in accordance with claims 1 or 3 further including at least one additional array of simultaneously operable radiation devices to provide a plurality of such arrays, said plurality of arrays rotatable about said focal circle with substantially equal angular spacing therebetween, each of said arrays operable over a selected frequency band that differs from selected frequency bands of the other arrays of said plurality of arrays.

5. An antenna in accordance with claim 2 wherein said transreflector is an annulus of said surface of revolution, said annulus being located above the plane of said internal focal circle.

6. An antenna in accordance with claims 2 or 5 further including at least one additional flared horn with said reflecting grids positioned in said open end thereof to provide a plurality of such flared horns, said plurality of flared horns rotatable about said focal circle with substantially equal angular spacing therebetween, each of said flared horns operable over a selected frequency band that differs from selected frequency bands of the other-flared horns in said plurality of flared horns.

* * * * *